United States Patent [19]

Chaiko et al.

[11] 4,400,113

[45] Aug. 23, 1983

[54] FRICTION ROCK STABILIZER AND A METHOD OF ISOLATING THE SAME FROM A BORE SURFACE

[75] Inventors: Walter M. Chaiko, Titusville, N.J.; John A. Larson, Easton, Pa.

[73] Assignee: Ingersoll-Rand Company, Woodcliff Lake, N.J.

[21] Appl. No.: 159,184

[22] Filed: Jun. 13, 1980

[51] Int. Cl.[3] ..... E21D 20/02

[52] U.S. Cl. ..... 405/261; 405/259; 411/60

[58] Field of Search ..... 405/259, 260, 261, 262; 52/155; 411/15, 60

[56] References Cited

U.S. PATENT DOCUMENTS

| | | | |
|---|---|---|---|
| 3,641,772 | 2/1972 | Dietrich | 405/260 |
| 4,012,913 | 3/1977 | Scott | 405/259 X |
| 4,022,101 | 5/1977 | Helgesson | 411/60 |
| 4,051,681 | 10/1977 | Yaros | 405/261 |
| 4,112,637 | 9/1978 | Herbst | 52/155 |
| 4,124,983 | 11/1978 | Weatherby | 405/260 |
| 4,188,158 | 2/1980 | Donan et al. | 405/259 |

FOREIGN PATENT DOCUMENTS

| | | | |
|---|---|---|---|
| 269002 | 3/1969 | Austria | 405/259 |
| 2328130 | 5/1977 | France | 405/260 |
| 78/5306 | 9/1978 | South Africa | 405/259 |

*Primary Examiner*—David H. Corbin
*Attorney, Agent, or Firm*—B. J. Murphy

[57] ABSTRACT

The friction rock stabilizer comprises an elongate element for insertion into an earth structure bore, for stabilizing the earth structure, which has a sheath rendering the stabilizer impervious to chemical attack and, hence, corrosion-resistant. The bore surface isolating method, in an embodiment thereof, comprises interposing a protective or isolating sleeve or lining between the stabilizer and the earth structure bore. The protective or isolating lining provides two benefits: it facilitates movement of the stabilizer into frictional engagement with the bore, by isolating the stabilizer from the rough surface of the bore wall, and also provides a corrosion-resistant sheath to protect the stabilizer, in the bore, from alkaline or acidic mine water, corrosive minerals, and the like.

30 Claims, 12 Drawing Figures

FIG. 1
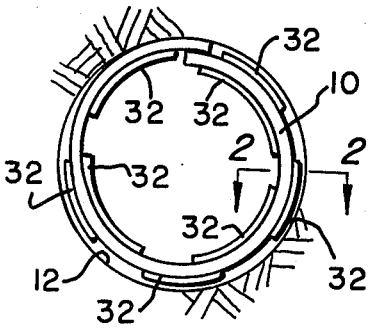
FIG. 2
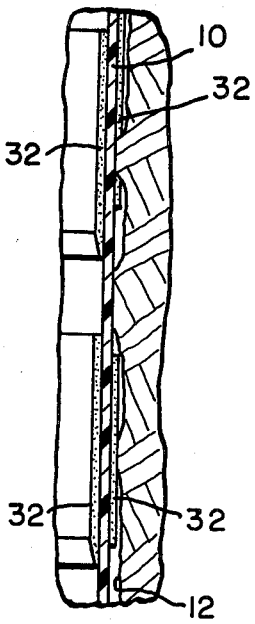
FIG. 3
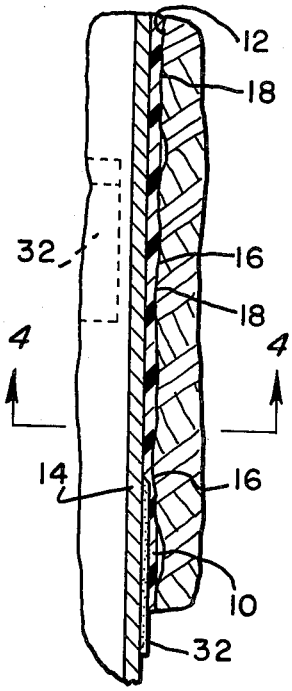
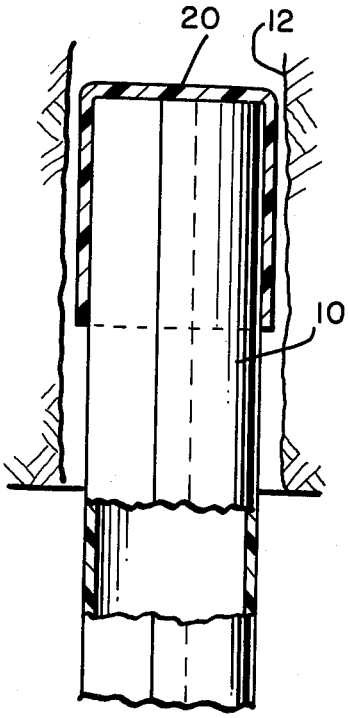
FIG. 5
FIG. 6
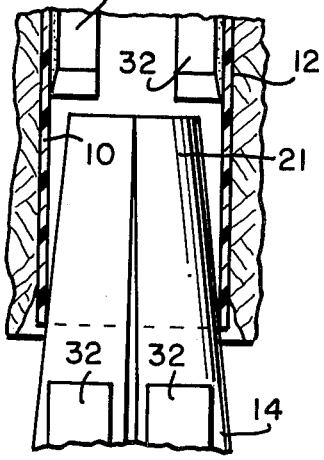
FIG. 7
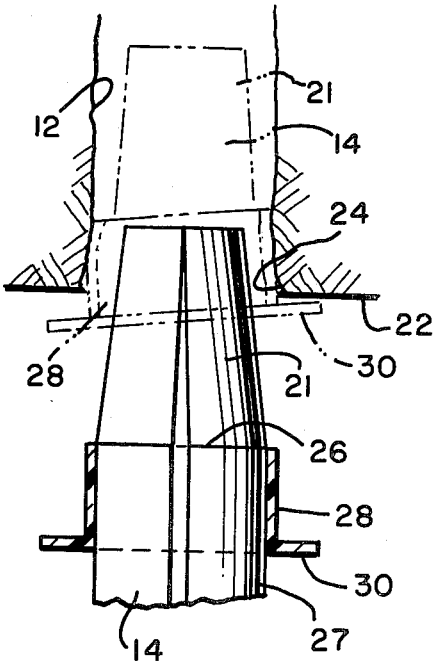
FIG. 4
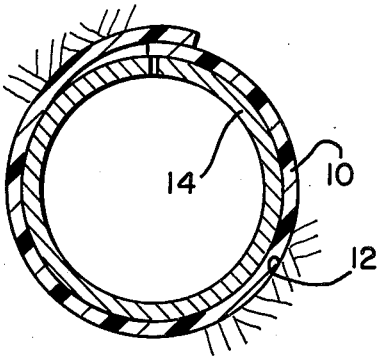

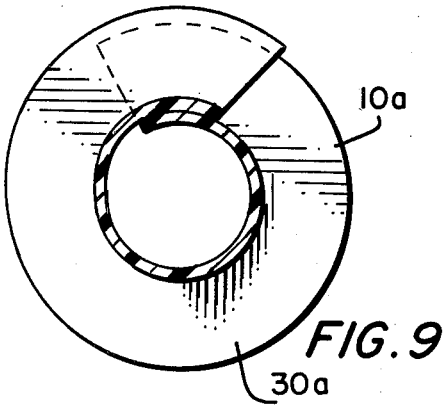
FIG. 9
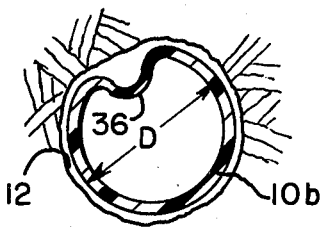
FIG. 12
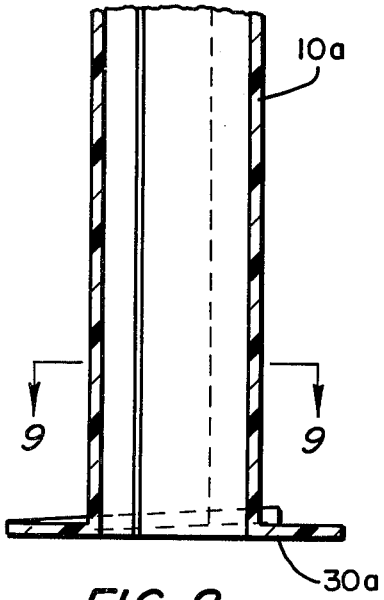
FIG. 8
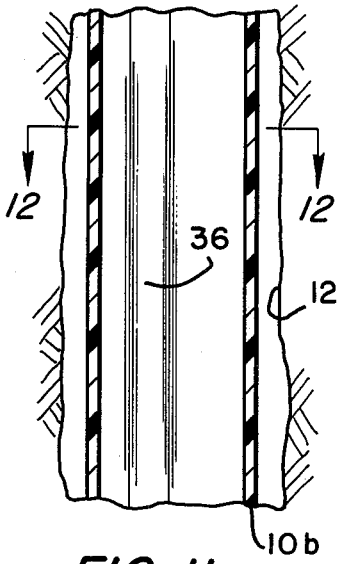
FIG. 11
FIG. 10
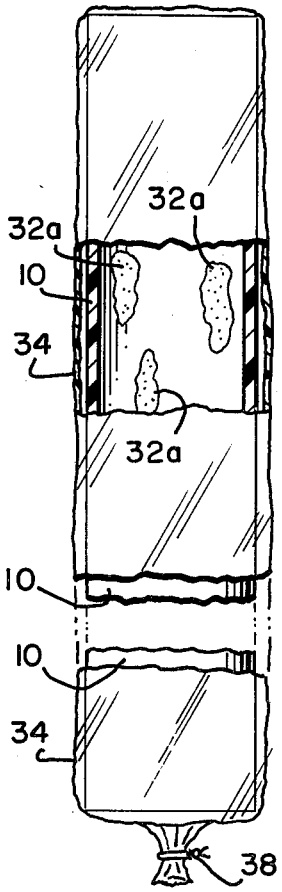

FRICTION ROCK STABILIZER AND A METHOD OF ISOLATING THE SAME FROM A BORE SURFACE

This invention pertains, generally, to (a) methods of inserting and/or fixing friction rock stabilizers in earth structure bores, and in particular to a method of isolating the outer surface of a friction rock stabilizer, in a closed end earth structure bore, from the surface of the bore, and (b) a friction rock stabilizer, particularly a stabilizer which is impervious to chemical attack and, hence, is corrosion-resistant.

There are many applications where it is necessary to protect the surface of a friction rock stabilizer from water, chemicals, and the like, which obtain in many mine environments, and which would cause the general degradation of the stabilizer in a relatively short period of time. Also, typically the surface of an earth structure bore is irregular and coarse and, as a consequence, frictionally resists entry therein by the stabilizer. By shielding or isolating the stabilizer from the bore surface, and presenting a smooth, low friction surface to the stabilizer, the aforesaid frictional resistance can be markedly reduced.

It is an object of this invention, therefore, to set forth a novel method of protection or isolation of the outer surface of a friction work stabilizer from an earth structure bore.

It is also an object of this invention to disclose a new, corrosion-resistant friction rock stabilizer.

Particularly, it is an object of this invention to set forth a method of isolating the outer surface of a friction rock stabilizer, in a closed-end earth structure bore, from the surface of the bore, comprising the step of interposing a lining between at least a portion of the surface of the bore and the stabilizer.

It is another object of this invention to define a friction rock stabilizer, for stablizing an earth structure, comprising: an elongate element for resisting movement of an earth structure from within a bore, for receiving said element therewithin, formed in the earth structure; said element comprising means for exerting an earth stabilizing force against the surface of such an earth structure bore; and means sheathing the exterior surface of said element for isolating said exterior surface from the surface of such an earth structure bore; wherein said force-exerting means comprises means cooperative with the surface of such an earth surface bore for sealing said sheathing means against said exterior surface of said element.

Further objects of this invention, as well as the novel features thereof, will become more apparent by reference to the following description, taken in conjunction with the accompanying figures in which:

FIG. 1 is a bottom view, that is, a view from the bottom of a bore, looking upward, in which a protective, isolating lining, according to a teaching of this invention, can be viewed therein;

FIG. 2 is a cross-sectional view taken along Section 2—2 of FIG. 1;

FIG. 3 is a cross-sectional view similar to that of FIG. 2, but which shows a portion of a friction rock stabilizer in engagement with the lining;

FIG. 4 is a cross-sectional view taken along Section 4—4 of FIG. 3;

FIG. 5 is a partial view of a protective lining having a protective cap in place on the leading end thereof;

FIG. 6 depicts the leading end of a stabilizer making an initial entry into a lined bore;

FIG. 7 is a fragmentary view of a friction rock stabilizer showing the leading end thereof adjacent to which is fixed a plastic band for facilitating stabilizer entry into the bore.

FIG. 8 is a vertical, cross-sectional view of a portion of an alternate embodiment of the lining, according to the invention;

FIG. 9 is a cross-sectional view taken along Section 9—9 of FIG. 8;

FIG. 10 is a discontinuous, and vertical cross-sectional view of a lining, according to the invention, closed or enveloped within a compliant, plastic bag;

FIG. 11 is a vertical, cross-sectional view of a portion of a further alternative embodiment of the lining, according to the invention; and FIG. 12 is a cross-sectional view taken along Section 12—12 of FIG. 11.

As shown in the figures, a smooth-surfaced, low-friction lining 10, according to a method comprised by this invention, is first freely placed into an earth structure bore 12, in order to: (a) facilitate the entry into the latter by the stabilizer 14, (b) to isolate the stabilizer from the roughened surface of the bore 12, and (c) to protect the stabilizer 14 from corrosion. Now, clearly, in an alternative practice of the invention, a protective lining could be fixed to the stabilizer 14, the latter being shipped thusly from a manufacturing site. However, typically the stabilizers are subjected to rough handling, in shipping, in the mine environments, and during insertion into the bore. Resultantly, linings or coatings fixed thereon can suffer abrasion, chipping, and the like. It is the preferred practice of the method to employ a simple, separate lining 10 which is mated to the stabilizer 14 at the site of the earth structure bore 12.

FIGS. 1 and 2, particularly, evidence the free, slidable engagement of the lining 10 with the bore 12. In view of this free fit, the lining 10 is overlapped at the edges thereof to insure that, when the stabilizer 14 is inserted, the lining 10 will fully sheathe the outer surface of the stabilizer, and will expand to engage the borehole.

FIG. 3 illustrates the circumstances obtaining, in the bore 12, after the stabilizer 14 has been forced thereinto, or expanded therewithin (by a mandrel, or the like). The lining 10 which, according to this embodiment, is plastic, is squeezed into the crevices and crannies 16 of the bore wall, and extruded from narrow spaces 18. The lining outer surface, in fact, substantially conforms to the roughened, irregularity of the wall of the bore 12, and is consequently held fast thereat as the stabilizer is forceably inserted, or expanded radially outward. The inner surface of the lining 10, however, remains smooth and slidably facilitates the movement of the stabilizer 14 into bore 12.

Patently, if the stabilizer 14 has a free diameter which is less than the bore diameter, and the stabilizer is to be expanded (by a mandrel, or such) after insertion, the lining 10, then, may sheathe the stabilizer prior to insertion of the latter so that both the lining 10 and the stabilizer may enter the bore together in one insertion step.

The stabilizer 14, in being hollow, ordinarily would allow mine water, methane gas, etc., to enter through the center thereof, unless the end were capped. It is accordingly a teaching of this invention to dispose a cap 20 on the leading end of the lining 10 as shown in FIG. 5. The stabilizer 14, as shown in FIG. 6, simply enters the bore 12, sliding upon the inner surface of the lining 10, and the leading end 21 moves into the shelter provided therefor by cap 20 which is perched atop the lining 10 (FIG. 5) near the end of the bore. As the lining 10 expands, radially, to accomodate the stabilizer 14, the cap 20, also, stretches, as necessary, correspondingly.

Commonly, as it opens onto a free face 22, the open end of a bore 12 results in a slightly widened mouth. Rock fragments more readily break away from the entry end, and present a somewhat tapered access. It is through this access 24 which the "knee" 26 (i.e. between the tapered, necked-down, leading end portion 21 and the uniform diameter portion 27) of the typical, over-sized stabilizer 14 must frictionally pass, while contracting to negotiate the undersized bore 12. It is an ancillary teaching of our invention to fit a band 28 (FIG. 7) about the stabilizer 14, immediately adjacent to the knee 26, to smooth the movement of the stabilizer 14 through the access 24. As the band 28 comes upon the access 24, it will engage and hold fast thereat, perhaps even in a canted attitude (as shown in dashed outline), and define a smooth lining for access 24. To insure that the band 28 does not travel into the bore 12 with the stabilizer 14, it has a large flange 30 formed thereon to engage the face 23 of the earth structure.

As a further derivation of the just-described practice, the invention also comprehends the use of a lining **10*a* which has an integral flange 30*a*, as shown in FIGS. 8 and 9. Here, the same aforesaid benefit obtains; the lower end of the lining 10*a* will line the access 24 (FIG. 7) of the bore 12, and the flange 30*a* prevents the lining from travelling upwardly from the face 22**.

As has been noted, and as will be self-evident in the light of this teaching, the lining 10 or **10*a* greatly facilitates the entry of the stabilizer 14 into the bore 12. Simply, there obtains a greatly reduced friction coefficient between the plastic lining 10 and the metal stabilizer 14. Now, recent theories of rock mechanics and roof support in mines have indicated a benefit in maintaining a compressive pressure in the roof rock. This is often illustrated in terms of a pressure bulb surrounding a roof bolt. In some first experimental tests of the subject method, stabilizers were driven into a heavy force fit in roof bores, but at modest thrusting loads (because of the very much reduced friction coefficient between the plastic lining 10 and the metal stabilizer 14**). This results in ground pressures several times as high as the conventional installation, and should extend the influence of the pressure bulb further into the roof rock.

The aforesaid teaching, of isolating the stabilizer 14, facilitating its bore entry, and protecting it from corrosion, by means of a low-friction lining 10 or **10*a*, has its price. Frequently, the set anchorage of the stabilizer 14 is not sufficient for reliable earth stabilization. To overcome this possible limitation, then, it is further a teaching of this invention to disclose the use of adhesive packs 32 (or adhesive wicking materials, or thixotropic or anaerobic paste) on the inner or inner and outer surface of the lining 10 or 10*a*, or on the outer surface of the stabilizer 14 (FIGS. 3 and 6), so that, when an undersized stabilizer 14 is forced into the bore 12, sliding upon the lining surface, the packs 32 rupture, (or the stabilizer exudes the wicking adhesive, or activates the paste) and the adhesive is spread axially and radially. The adhesive (or paste) spreads over the inner surface of the lining 10 (or 10*a*), and the outer surface of the stabilizer 14; it reduces still further the frictional resistance of stabilizer installation, serving as a lubricant during installation and, thereafter, it seizes and locks both the lining 10 (or 10*a*) and the stabilizer 14** in place.

Some adhesives, cements, epoxies, pastes, etc., albeit their uncommon effectiveness, have awfully offensive odors. In mine environments, where clean, fresh air is a rarity, such odors can be an unwarranted burden. We propose, then, as an ancillary practice of our invention, to enshroud the adhesive- or paste-bearing lining in a covering. FIG. 10 illustrates this practice, where a lining 10, having thixotropic paste **32*a* fixed on the inside surface thereof, is enveloped by a thin, pliant, plastic bag 34. Bag 34 has only one open end which is gathered and closed off with a tie 36. Such paste-bearing linings 10, bagged as shown, can be handled and passed into mine sites without exposing personnel to the paste 32*a* or the odors thereof. Also, the paste is protected from dirt, moisture, etc., and sealed off from oxygen, until the lining has been placed into a bore 12. The bag 34 also prevents evaporation of solvents or monomers from the adhesive or paste and, therefore, keeps the latter in workable condition. At that time, the bag 34 is ruptured, at the lowermost end, to admit a stabilizer 14 thereinto. Patently, the bagged "article" may include a cap 20 (FIG. 5) on the leading end of the lining 10. In lieu of the loose-fitting, pliant bag 34, the lining 10 may be enveloped, tautly, by a thin, heat-shrunk plastic which will not be so susceptible to snags and tearing as is bag 34**.

The linings 10 and **10*a* have been shown to be axially slit. Well, this is arbitrary. The practice of the invention comprises circumferentially continuous linings, one such lining 10*b* being illustrated in FIGS. 11 and 12. Either preformed, or formed at the bore site by manipulation, lining 10*b* defines an axially-extending, inwardly-directed rib 36 which comprises, in a manner of speaking, reserved, circumferential material. With the rib 36, the lining 10*b* makes a simple entry into the bore 12. Subsequently, as a stabilizer 14 is pushed thereinto, the rib 36 is displaced outwardly, and the effective circumference of the lining 10*b* enlarges to engage the wall of the bore. Lining 10*b*, of course, will accomodate a cap 20 (FIG. 5) having a free, relaxed diameter "D" which will, however, stretch radially, as necessary, when the stabilizer 14** is forced into place.

The use and functioning of the friction rock stabilizer 14 in anchoring or stabilizing an earth structure, from within a bore 12 formed in the structure to receive the stabilizer therewithin, has been fully disclosed in prior U.S. patents. The James J. Scott reissued patent, U.S. Pat. No. Re. 30,256, of Apr. 8, 1980, for "Friction Rock Stabilizers", is probably the more exemplary. As known therefrom, the stabilizer 14 comprises means for exerting an earth stabilizing force against the surface of the bore 12. The stabilizer 14 of the instant invention, then, employs this force also, in cooperation with the surface of the bore 12, to seal the lining 10 (or **10*a*) against the exterior surface of the stabilizer 14, while the lining coincidentally isolates the stabilizer from the surface of the bore 12. The lining which sheathes the novel stabilizer 14, to render the same corrosion-resistant, may comprise the simple lining 10 (of FIGS. 1–4), the lining 10*a* (of FIG. 8), the lining 10*b* (of FIG. 12), or any of the aforesaid with the cap 20 (of FIG. 5**) to prevent entry of earth substances into the leading end of the stabilizer.

While we have described our invention in connection with specific methods of its practice, and specific embodiments of stabilizers, it is to be clearly understood that this is done only by way of example, and not as a limitation to the scope of our invention as set forth in the objects thereof and in the appended claims. From our teachings it will be apparent that stabilizers 14 may be fabricated, and delivered to installation sites, with sheaths or linings already coated on or bonded thereto. These stabilizers, then, can be bonded adhesively to second linings in the borehole. Our disclosure comprises this practice, and is within the ambit of our claims, as are all such varied embodiments which will occur to those skilled in this art from our teachings.

We claim:

1. A method of isolating the outer surface of a friction rock stabilizer, in a closed-end earth structure bore, from the surface of the bore, comprising the step of:

interposing only a single lining, of pre-formed, plastic material, which lining has a smooth, low-friction surface, between at least a portion of the surface of the bore and the stabilizer; wherein said interposing step comprises disposing said smooth, low-friction surface (a) in direct, contacting and only a slidable engagement with the outer surface of the stabilizer, and (b) in full circumscription of the outer surface of the stabilizer, to accommodate a relative, slidable movement between the outer surface of said stabilizer and the low-friction surface of the lining, and to insure a fully-circumscribing isolation of the outer surface of the stabilizer from the surface of the bore; and said interposing step further comprises disposing said lining in direct, contacting engagement with the surface of the bore.

2. A method, according to claim 1, wherein:

said interposing step comprises interposing a lining which sheathes substantially the entirety of at least one of said surfaces.

3. A method, according to claim 1, wherein:

said interposing step comprises inserting an expandible lining into the bore.

4. A method, according to claim 1, wherein:

said interposing step comprises inserting into the bore a lining which has an undulation formed in the periphery thereof.

5. A method, according to claim 1, wherein:

said interposing step comprises inserting a split, tubular lining into the bore.

6. A method, according to claim 3, further including:

installing the friction rock stabilizer into the bore following the insertion of the lining.

7. A method, according to claim 2, wherein:

said interposing step further comprises interposing a lining of corrosive-resistant material.

8. A method, according to claim 2, further including:

interposing an adhesive between the lining and at least one of said surfaces.

9. A method, according to claim 8, wherein:

said adhesive-interposing step comprises interposing the adhesive between the lining and said stabilizer surface.

10. A method, according to claim 8, wherein:

said adhesive-interposing step comprises interposing the adhesive between the lining and said bore surface.

11. A method, according to claim 8, wherein:

said adhesive-interposing step comprises interposing the adhesive between the lining and both of said surfaces.

12. A method, according to claim 3, further including:

applying an adhesive to a surface of said lining before inserting said lining into the bore.

13. A method, according to claim 12, wherein:

said applying step comprises applying an adhesive to the inner surface of said lining.

14. A method, according to claim 12, wherein:

said applying step comprises applying an adhesive to the outer surface of said lining.

15. A method, according to claim 12, wherein:

said applying step comprises applying an adhesive to both inner and outer surfaces of said lining.

16. A method, according to claim 8, wherein:

said adhesive-interposing step comprises applying an adhesive to the surface of the stabilizer.

17. A method, according to claim 1, wherein:

said stabilizer has a leading end; and said interposing step comprises fixing a band about the stabilizer adjacent the leading end thereof.

18. A method, according to claim 1, further including:

disposing a cap between the closed end of the bore and the stabilizer.

19. A method according to claim 18, wherein:

said lining has a leading end; and said cap disposing step comprises emplacing the cap onto the leading end of the lining before installing the lining into the bore.

20. A method, according to claim 18, wherein:

said stabilizer has a leading end; and said disposing step comprises disposing a cap of corrosive-resistant material between said end of the bore and the leading end of the stabilizer.

21. A method, according to claim 3, wherein:

said lining has a trailing end; and said interposing step comprises inserting into the bore a substantially tubular lining which has an outwardly-extending, radial flange formed on the trailing end thereof, which flange has a greater diameter than has the earth structure bore; and said inserting step comprises inserting the lining into the bore until the radial flange comes into engagement with the earth structure.

22. A method, according to claim 12, further including:

wholly enclosing the entirety of said lining in a sealed envelope, following said adhesive-applying step.

23. A friction rock stabilizer, for stabilizing an earth structure, comprising:

an elongate element for resisting movement of an earth structure from within a bore, for receiving said element therewithin, formed in the earth structure;

said element comprising means for exerting an earth stabilizing force against the surface of such an earth structure bore; and only a single lining, formed of preformed, plastic material having a smooth, low-friction surface, fully circumscribing the exterior surface of said element for isolating said exterior surface fully thereabout from the surface of such an earth structure bore; wherein said smooth, low-friction surface of said lining is in direct, contacting and only a slidable engagement with said exterior surface of said element to facilitate a relative slidable movement between said exterior surface and said low-friction surface; and said lining comprises means for effecting a direct, contacting engagement thereof with the surface of an earth structure bore for isolating said element from said bore surface.

24. A friction rock stabilizer, according to claim 23, wherein:

said lining is formed of inert, corrosion-resistant material.

25. A friction rock stabilizer, according to claim 23, wherein:

said lining comprises means for preventing contact of earth substances with said exterior surface of said element.

26. A friction rock stabilizer, according to claim 23, wherein:

said element is substantially hollow, having an interior surface; and said lining comprises means for preventing contact of earth substances with said interior surface.

27. A friction rock stabilizer, according to claim 23, wherein:

said lining comprises means for sealing at least one end of said element from the environment.

28. A friction rock stabilizer, according to claim 27, wherein:

said element has a leading, initial-bore-entry end, and a trailing, final-bore entry end; and said sealing means seals said leading end.

29. A friction rock stabilizer, according to claim 23, wherein:

said element is formed of a material which is deformable, in response to transverse force applied thereto by a shifting surface of such an earth structure bore, whereby resistance of said element to movement of earth lengthwise of said element is increased.

30. A friction rock stabilizer, according to claim 23, further including:

means interposed between said element and said lining which, in a first mode, permits relative movement between said element and said lining, and which, in a second mode, inhibits such relative movement.

* * * * *